US007344136B2

(12) United States Patent
Schultz

(10) Patent No.: US 7,344,136 B2
(45) **Date of Patent: *Mar. 18, 2008**

(54) SYSTEM AND METHOD FOR PLAYING A BONUS GAME

(75) Inventor: David B. Schultz, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 36 days.

This patent is subject to a terminal disclaimer.

(21) Appl. No.: 11/164,151

(22) Filed: Nov. 11, 2005

(65) Prior Publication Data

US 2006/0038348 A1 Feb. 23, 2006

Related U.S. Application Data

(63) Continuation of application No. 10/826,029, filed on Apr. 15, 2004, now Pat. No. 7,000,921.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,853,325 A * 12/1998 Kadlic ..... 463/13
5,908,353 A * 6/1999 Andrews ..... 463/13
6,070,872 A * 6/2000 Squitieri ..... 273/292
6,126,542 A * 10/2000 Fier ..... 463/16
6,149,156 A * 11/2000 Feola ..... 273/292
6,174,235 B1 1/2001 Walker et al.
6,299,532 B1 * 10/2001 Smith ..... 463/13
6,357,749 B1 * 3/2002 Feola ..... 273/292
6,379,245 B2 * 4/2002 De Keller ..... 463/13
6,416,406 B1 * 7/2002 Duhamel ..... 463/12
6,457,714 B1 * 10/2002 Feola ..... 273/274
6,536,769 B1 * 3/2003 Palacios et al. ..... 273/292
6,969,316 B2 * 11/2005 Jarvis et al. ..... 463/12
7,000,921 B2 * 2/2006 Schultz ..... 273/292
7,104,544 B2 * 9/2006 Reiner et al. ..... 273/292
2005/0037834 A1 * 2/2005 Stern et al. ..... 463/20

* cited by examiner

*Primary Examiner*—Stephen Blau
*Assistant Examiner*—Dolores R. Collins
(74) *Attorney, Agent, or Firm*—Vanessa J. Owen; Robert L. Kovelman; J. P. Cody

(57) ABSTRACT

A method for playing a bonus game in association with a main game is provided. A bonus game is activated upon the occurrence of a predefined triggering event in the main game. Five cards are randomly drawn from an abridged deck of playing cards. The abridged deck of playing cards comprises at least thirteen cards all of a single suit. As few as none and as many as all five of the dealt cards are discarded and replaced with a card from the abridged deck of playing cards. The final hand is awarded a bonus payout based on the final hand of cards.

27 Claims, 4 Drawing Sheets

SYSTEM AND METHOD FOR PLAYING A BONUS GAME

CROSS-REFERENCE TO RELATED APPLICATIONS

This application is a continuation of U.S. application Ser. No. 10/826,029 filed on Apr. 15, 2004, now U.S. Pat. No. 7,000,921 which is herein incorporated by reference in its entirety.

BACKGROUND

Traditionally, bonus games are played in conjunction with initial or primary wagering games to enhance player interest and to increase the attractiveness of the wagering game. Generally, bonus games generate additional winnings beyond that which can usually be won during the normal play of a wagering game. The opportunity to receive the additional winnings entices the player to play this particular wagering game.

Current bonus games typically do not allow casino game players to utilize a strategy towards achieving a highly desirable outcome. Generally, the highly desirable outcome in a bonus game is merely receiving an additional payout award based upon randomly chosen events. These types of bonus games award a random value, which is determined entirely by the game. Other bonus games require players to select from a plurality of options to have bonus amounts revealed. But again, such values are randomly determined. What is needed is a new and interesting type of bonus game that allows a player to utilize strategy in affecting the outcome of the game.

Accordingly, those skilled in the art have long recognized the need for a bonus game that allows a player to use strategy and skill to maximize the bonus award.

SUMMARY

Briefly, and in general terms, a system and method for playing a secondary game in conjunction with a primary wagering game is provided. More particularly, the present invention provides a bonus game that allows a player to use strategy and skill to achieve a maximum winning bonus outcome. Still, more particularly, the present invention relates to a new method of playing poker.

In one embodiment of the present invention, a secondary game is activated upon the occurrence of a predefined triggering event in the primary wagering game. In this embodiment, a triggering event may be a particular winning combination of symbols, a particular number of consecutive wins, a particular time of day, or the detection of a particular player. Play of the secondary game begins by dealing a hand of cards randomly drawn from an abridged deck of playing cards. The abridged deck of playing cards comprises at least thirteen cards, all from a single suit. A final hand is formed by discarding as few as none, and as many as all, of the cards in the dealt hand. A card drawn from the abridged deck of playing cards replaces each card discarded from the initially dealt hand. The final hand is evaluated to determine a payout. The payout may be determined by comparing the final hand of cards to a standard poker payout table. A modified payment table may also be used. The determined payout may then be awarded to a game player.

Another aspect of the invention includes engaging in the play of a primary wagering game before activating the secondary game. Additionally, in another embodiment of the invention, play of the primary wagering game is disengaged upon the occurrence of the triggering event and play of the secondary game begins. Upon completion of the secondary game, which is after the final hand has been evaluated, the secondary game may be deactivated and play of the primary wagering game may be re-engaged. In another embodiment of the invention, the occurrence of the triggering event is detected before activating the secondary game. Additionally, the play of the secondary game may be delayed after detecting the occurrence of the triggering event.

In another aspect of one embodiment of the invention, the cards may be dealt all face-up, all face-down or in a combination of both face-up and face-down cards.

In one embodiment of the invention, a request to discard one or more cards in the dealt hand is received. Additionally, a request to hold as few as none and as many as all of the dealt cards may also be received.

In another embodiment of the invention, forming the final hand includes retaining all of the cards in the originally dealt hand and refraining from discarding any of the cards in the originally dealt hand. Alternatively, forming a final hand may include first permitting as few as none and as many as all of the dealt cards to be held in the final hand of cards and then discarding each of the cards not held in the final hand.

In a separate, different embodiment of the invention, one or more than one additional hand of cards is dealt to the game player. Each additional hand is dealt from a different abridged deck of playing cards and each abridged deck of playing cards contains at least thirteen cards, all from a single suit. Each of the cards in each additional hand is permitted to be discarded and replaced. The particular abridged deck of playing cards used to deal a specific additional hand is the same abridged deck of playing cards used to replace cards discarded from that specific additional hand. In other words, each hand has its own associated abridged deck of cards. Each additional hand is evaluated and awarded a payout. The payout for each hand is determined by comparing each additional hand to a standard poker payout table. Similarly, a modified poker payout table may be used.

Additionally, in another aspect of the invention, one or more requests to discard one or more cards in one or more of the additional hands is received. One or more of the requested cards from one or more of the additional hands may be discarded. Discarded cards are replaced with cards drawn from a particular abridged deck of cards associated with each specific hand. The particular abridged deck of cards used to deal a specific additional hand is the same particular abridged deck of cards used to replace cards discarded from that specific additional hand.

A different embodiment of the invention provides a method for playing a bonus game in conjunction with a main game. The method comprises engaging in the play of the main game. The bonus game is then activated upon the occurrence of a predefined triggering event in the main game. Play of the activated bonus game begins by dealing five cards randomly drawn from an abridged deck of playing cards. The abridged deck of playing cards comprises at least thirteen unique cards, all from a single suit. As few as none, and as many as five, of the dealt cards may be discarded. Each discarded card is replaced with a card from the abridged deck of playing cards, thereby forming a final hand of cards. A bonus payout amount is determined and then awarded.

Another embodiment of the invention includes receiving a request to evaluate the final hand of cards. The final hand of cards may be evaluated to determine the payout amount before awarding the bonus payout. Optionally, evaluating the final hand of cards comprises comparing the final hand of cards to a standard poker payout table to determine the amount of the bonus payout. Likewise, a modified payout table may be used.

In accordance with a different embodiment of the invention, the occurrence of the triggering event is detected before activating the bonus game. Optionally, in another embodiment, play of the main game is temporarily disengaged upon the occurrence of the triggering event in the main game. The play of the main game may then be re-engaged after awarding the bonus payout in the bonus game, but re-engagement is not required. Optionally, in a separate embodiment of the invention, the game player may play an additional bonus game after the first bonus payout is awarded. Alternatively, the bonus game may be deactivated after awarding the bonus payout, thus requiring a supplemental wager before play can proceed.

In an alternative embodiment of the invention, the bonus game may be delayed after detecting the occurrence of the triggering event.

A different embodiment of the invention includes receiving a request to discard one or more of the dealt cards, discarding one or more of the cards requested to be discarded and replacing each of the one or more discarded cards with a card from the abridged deck of cards.

Another different embodiment of the invention includes selecting cards to be held in the hand. The number of selected cards may be as few as none and as many as all of the five dealt cards. The cards not selected to be held in the hand are discarded and replaced with a card drawn from the abridged deck of cards.

Alternatively, one embodiment of the invention includes first permitting the selection of cards to be held in the hand. As few as none and as many as all of the five dealt cards may be selected as held cards. The unselected cards are then discarded and replaced.

Optionally, one embodiment of the invention includes dealing more than one additional hand. Each additional hand is dealt from a different abridged deck of playing cards and each abridged deck of playing cards comprises at least thirteen cards all from a single suit. Cards in each additional hand are permitted to be discarded and replaced. The particular abridged deck of playing cards used to deal a specific additional hand is the same abridged deck of playing cards used to replace cards discarded from that specific additional hand. In other words, each additional hand has its own associated abridged deck of cards. A bonus payout is awarded for each additional hand. The bonus payment is determined by comparing each additional hand to a standard poker payout table, or to a modified payout table.

Additionally, one or more requests to discard cards in one or more of the additional hands may be received. Each of the requested cards from the one or more additional hands may be discarded. The discarded cards may be replaced, wherein the particular abridged deck of cards used to deal a specific additional hand is the same particular abridged deck of cards used to replace cards discarded from that specific additional hand.

Another embodiment of the invention provides a method, under the control of a game player, for playing a bonus game in conjunction with a main game. The method includes playing a main game having a predefined triggering event for activating a bonus game. The bonus game is activated upon the occurrence of the predefined triggering event during the play of the main game by the game player. During the bonus game, the game player receives five cards randomly drawn from an abridged deck of playing cards. The abridged deck of playing cards has at least thirteen unique cards all of a single suit. The game player selects as few as none or as many as all of the five received cards to be held in the final hand and discards the unselected cards. Replacement cards are then drawn from the abridged deck of cards to complete the final hand of five cards. The game player receives a payout award based on the comparison of the final hand to a standard poker payout table or to a modified payout table.

In accordance with another embodiment of the invention, the game player issues a request to have as few as none and as many as all of the cards in the hand discarded. Alternatively, the game player issues a request to hold one or more cards in the hand of cards. Optionally, the game player may request one or more replacement cards. Additionally, the game player may submit the final hand for evaluation.

One embodiment of the invention provides a system for playing a bonus game to be played in conjunction with a primary or initial game. The system comprises means for engaging in the play of the primary or initial game, means for activating the bonus game during the play of the primary or initial game, means for dealing a hand of five cards randomly drawn from an abridged deck of playing cards, means for forming a final hand of cards, and means for awarding a payout. The abridged deck of playing cards used with the bonus game consists of at least thirteen cards all of a single suit. The final hand is formed by discarding as few as none and as many as all of the five cards in the dealt hand. Each discarded card is replaced by a card from the abridged deck of playing cards. Additionally, the payout is determined by comparing the final hand of cards to a standard poker payout table, or in a modified payout table.

Another embodiment of the invention provides a gaming machine configured to provide a bonus game to be played in conjunction with a main wagering game. The bonus game comprises dealing five cards to a game player. The cards are randomly drawn from an abridged deck of playing cards. The abridged deck of playing cards has at least thirteen cards all of a single suit. As few as none and as many as all of the dealt cards may be discarded. All of the discarded cards are replaced with a card drawn from the abridged deck of playing cards. The final hand of cards is evaluated and compared to a standard poker payout table to determine an award amount. The award amount is then awarded to the game player.

In another embodiment, the abridged deck of cards employs symbols, as opposed to, standard poker suits. In still another embodiment, more or less than thirteen cards are used to form the abridged deck. For example, a wild card may be used.

These and other features and advantages of the present invention will become apparent from the following detailed description, taken in conjunction with the accompanying drawings, which illustrate by way of example, the features of the present invention.

DETAILED DESCRIPTION

Figure 1:
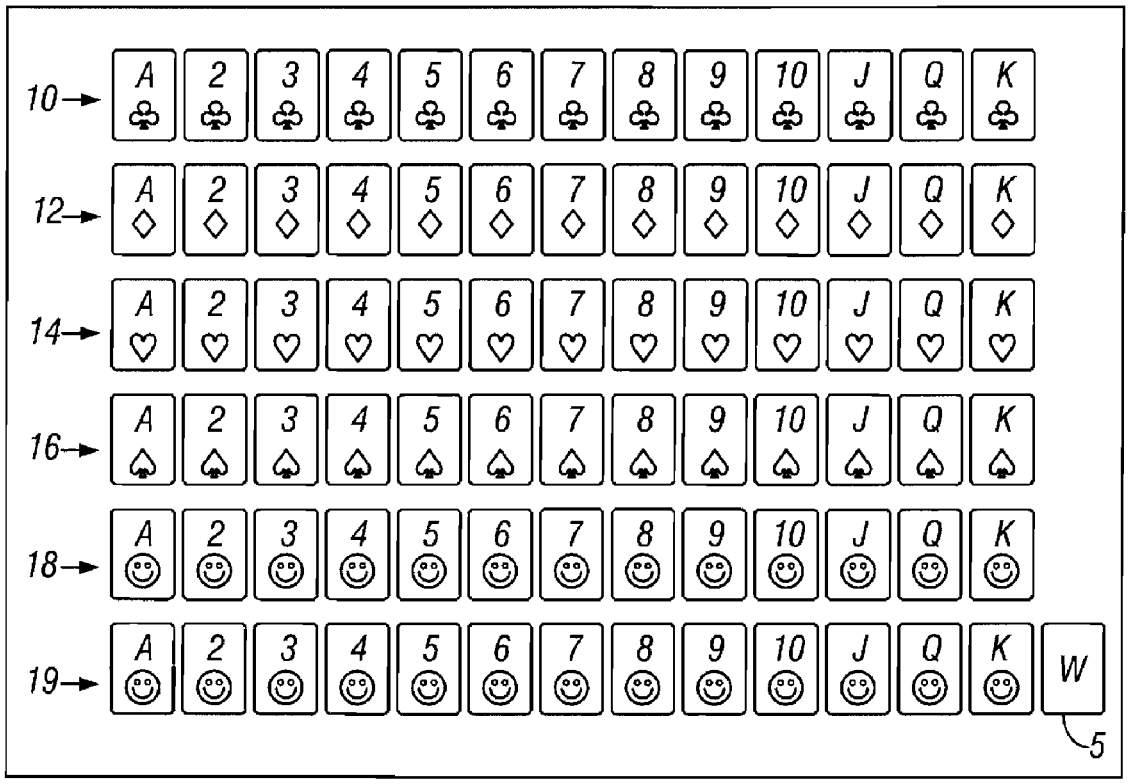
FIG. 1 illustrates multiple examples of same-suited abridged decks of playing cards in accordance with one embodiment of the present invention.

The invention is directed to a system and method for playing a bonus game in conjunction with a primary or main wagering game. The system and method provides the game player with the increased opportunity of achieving a higher payout in each bonus game by using player strategy and skill. Embodiments of the game system and method are illustrated and described herein by way of example only and not by way of limitation.

In one embodiment of the invention, a bonus game is provided to be played in conjunction with the play of a main wagering game. The bonus game provides the game player with the opportunity to generate extra winnings that usually cannot be won during the normal play of a main wagering game. Generally, the main wagering game can be any casino-type game, which may include, but is not limited to card games, mechanical slot machines and video game machines, such as video slots and video poker.

Associated with the main game are triggers for activating the bonus game. The triggers are defined events occurring during the play of the main wagering game. Virtually any event can be defined as a triggering event. For example, a triggering event can be defined as a particular winning combination of symbols, a particular number of consecutive wins, a particular time of day, or the detection of a particular player. The aforementioned listing of examples is merely illustrative and does not serve to limit triggering events to the examples specified.

During the play of the main wagering game, the bonus game is activated upon the occurrence of a predefined triggering event. Play of the activated bonus game begins by dealing five cards to a player. The cards in the bonus game are dealt from an abridged deck of same-suited playing cards rather than a standard deck of fifty-two playing cards.

Referring now to the drawings, wherein like reference numerals denote like or similar elements throughout the drawings, and more particularly to FIGS. 1-8, there is shown a system and method for playing a bonus game.

Referring particularly to FIG. 1, several examples of same-suited abridged decks of playing cards which are suitable for use with the bonus game are illustrated. Specifically, the deck 10 is an abridged deck of thirteen unique cards where all the cards are clubs. More particularly, the deck 10 contains one of each of the following cards: ace, two, three, four, five, six, seven, eight, nine, ten, jack, queen and king. Additionally, the cards in the abridged deck can consist of all diamonds, all hearts, or all spades, as shown in decks 12, 14 and 16, respectively. The suit of the abridged deck of playing cards is not limited to traditional, standard suits (e.g. clubs, diamonds, hearts and spades). Rather, any type of marking or image may be depicted on the cards in the abridged deck. The marking or image serves as a graphical representation and is useful in distinguishing one deck of playing cards from another deck of playing cards. Therefore, it does not necessarily matter what type of marking is used, but it is important that the depicted marking or suit is the same on all of the cards in an abridged deck of playing cards.

FIG. 1 illustrates an example of a non-traditional abridged deck of playing cards which many be used in accordance with the present invention. Specifically, the abridged deck 18 shown in FIG. 1 consists of thirteen unique cards with the same, but non-traditional markings.

Of course, one of ordinary skill in the art will appreciate that the abridged deck of cards may comprise more or less than thirteen cards. For example, a wild card may be added with the deck of thirteen cards to make a deck having fourteen cards, which is illustrated in FIG. 1. Specifically, abridged deck 19 shown in FIG. 1 consists of fourteen cards, including a wild card 5. Optionally, the abridged deck of cards may comprise more than one wild card (not shown).

The abridged deck of same-suited playing cards is used to randomly deal five cards to a player. The player is allowed to discard and to draw as many as five cards. If any cards are discarded, then replacement cards are drawn from the abridged deck of cards to complete the hand. The final hand is then compared to a standard poker payout table to determine a payout amount. Alternatively, any type of pay table may be used.

Since an abridged deck of same-suited cards is used for the bonus game, the final hand will be a flush, straight flush or royal flush. Using an abridged deck of same-suited cards rather than the standard multi-suited, fifty-two card deck, provides the possibility for a royal flush in every game, i.e. a hand yielding the highest potential payout. This allows the player to utilize strategy in affecting the player's bonus outcome.

Figure 2:
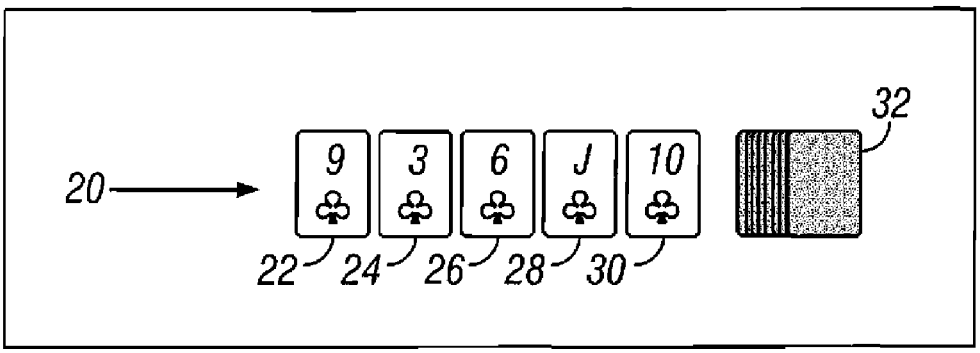
FIG. 2 illustrates an example of a hand of cards dealt to a game player while playing a bonus game in accordance with an embodiment of the invention.

Referring to FIG. 2, an example of five cards dealt from an abridged deck of playing cards is shown. Specifically, hand 20 includes cards 22, 24, 26, 28 and 30, all dealt from the abridged deck of cards 32. The cards in hand 20 have all been dealt face-up. However, in different embodiments of the invention, the cards are all dealt face-down, or alternatively, the cards are dealt in a combined fashion such that some of the cards are dealt face-down and some are dealt face-up.

Figure 3:
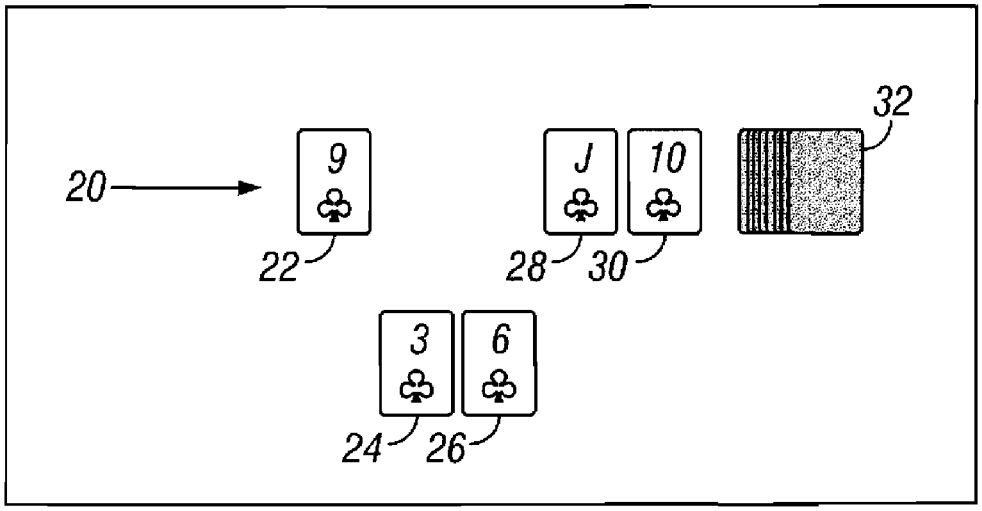
FIG. 3 illustrates a hand of cards played during the bonus game in accordance with an embodiment of the invention.

Once the cards have been dealt, the player may then choose whether to discard any of the cards from the hand. For this example, the player has chosen to discard two cards, which is illustrated in FIG. 3. Cards 24 and 26 are the two cards selected to be discarded, and therefore, the cards have been removed from hand 20. The player now holds cards 22, 28 and 30 in hand 20 of FIG. 3. Two cards are drawn from the abridged deck 32 to replace the discarded cards and to complete the hand 20.

Figure 4:
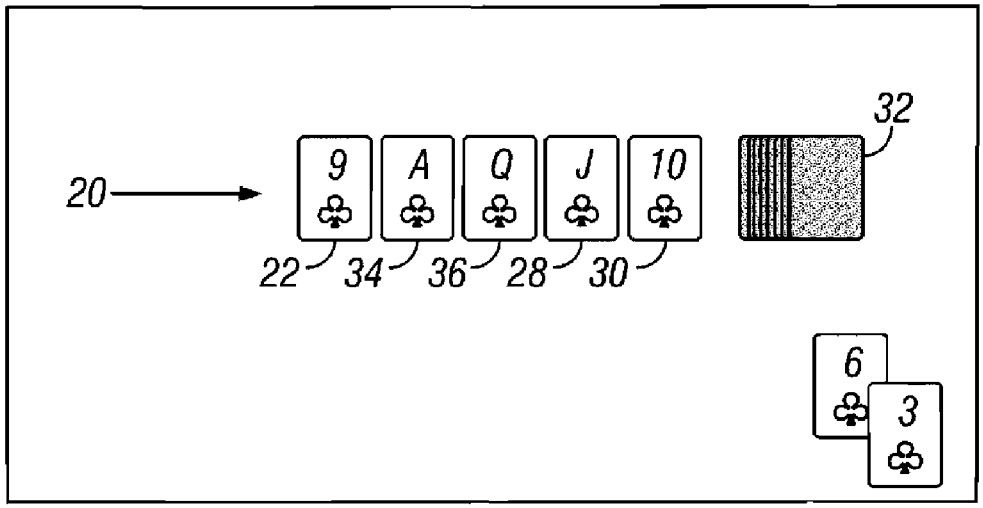
FIG. 4 illustrates an example of a final hand of cards formed during play of the bonus game in accordance with an embodiment of the invention.

FIG. 4 illustrates a final hand 20 where cards 34 and 36 were drawn from abridged deck 32 to complete the hand. The final hand 20 is then compared to a standard poker payout table to determine a payout amount. Final hand 20, as shown in FIG. 4, is a flush. Accordingly, the amount of the bonus payout would be equivalent to the standard poker payout for a flush.

It is important to note that the game player is not required to discard any of the cards dealt in the initial hand, and may choose to hold all of the originally dealt cards. However, in an alternative embodiment of the invention, the game player may be required to discard at least one of the dealt cards.

Once a bonus payout has been awarded, the bonus game may be deactivated and the game player may return to playing the main game. Alternatively, in another embodiment, the game player may play a new, different game after the bonus game is deactivated. Optionally, in yet another different embodiment, after a bonus payout has been awarded, the game player may be invited to play an additional bonus game.

In another, separate embodiment of the invention, more than one hand can be dealt to the game player. Each additional hand contains five cards and is dealt from a different abridged deck of playing cards. Each of the abridged decks of playing cards contains thirteen cards, all of the same suit. Optionally, each of the abridged decks of playing cards may contain more or less than thirteen cards.

Figure 5:
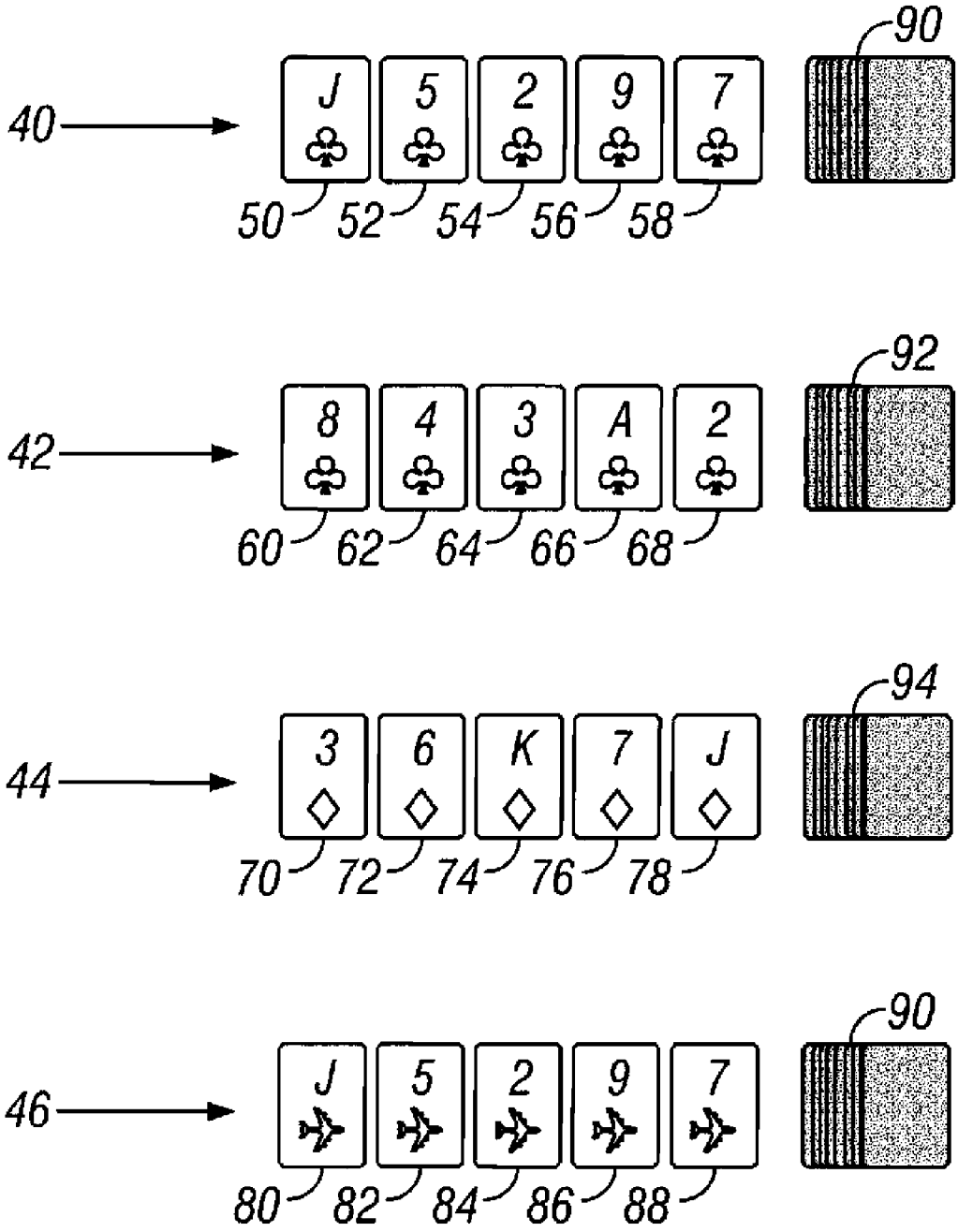
FIG. 5 illustrates additional hands of cards dealt to a single game player while playing the bonus game in accordance with one embodiment of the invention.

For example, referring to FIG. 5, a first hand 40 is dealt from deck 90 and an additional hand 42 is dealt from an additional deck 92. Even though the cards in hand 40 and the cards in hand 42 are all clubs, hands 40 and 42 were dealt from different abridged decks of cards. It is not necessary for the additional hand of cards to have the same suit as the cards in the first hand. For example, referring again to FIG. 5, a first hand 40 is dealt from deck 90 and an additional hand 44 is dealt from deck 94. The cards in deck 94 are all diamonds which is different from the clubs in deck 90.

The additional abridged decks of cards used to deal the additional hands can be of any suit or marking, as long as all of the cards in a particular deck are marked the same.

Furthermore, the suit of the cards in the additional abridged deck is not limited to the traditional suits of clubs, diamonds, hearts and spades. For example, additional hand 46 shown in FIG. 5 is dealt from an additional abridged deck 96 which contains cards having the same, but non-traditional suit.

FIG. 5 illustrates three possible additional card hands that may be dealt to a game player who has already been dealt a first hand. It will be appreciated that any number of additional hands can be dealt to the game player. FIG. 5 is provided for purposes of illustration only, and is not intended to limit or restrict the number of additional hands to three.

Figure 6:
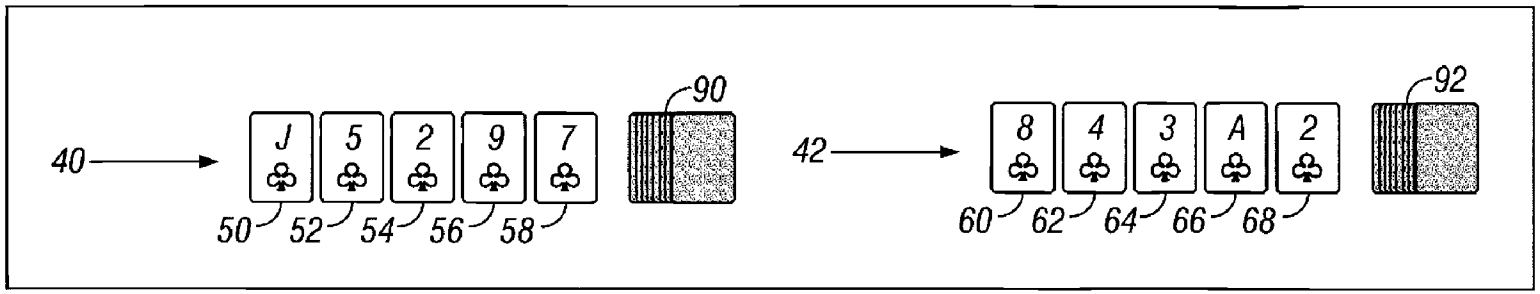
FIG. 6 illustrates two hands of cards dealt to a game player while playing the bonus game in accordance with one embodiment of the invention.
Figure 7:
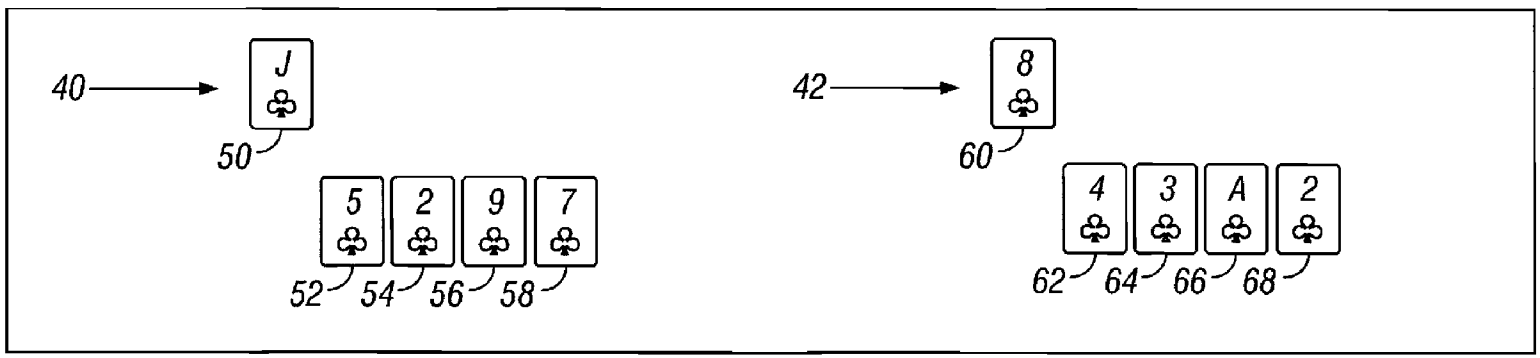
FIG. 7 illustrates two different hands of cards played in a bonus game in accordance with one embodiment of the invention.

In another example of an embodiment of the invention, multiple hands of cards are dealt to a game player. FIG. 6 illustrates a first hand 40 dealt from an abridged deck of cards 90 and an additional hand 42 dealt from an additional abridged deck of cards 92. The game player chooses which cards, if any, to discard from each hand. The game player may choose to discard as few as none, and as many as all, of the five cards from each hand. Additionally, the game player may choose to discard a different number of cards from each hand. FIG. 7 illustrates the cards removed from each hand. Specifically, cards 52, 54, 56 and 58 have been discarded from hand 40 and card 60 has been discarded from hand 42.

Figure 8:
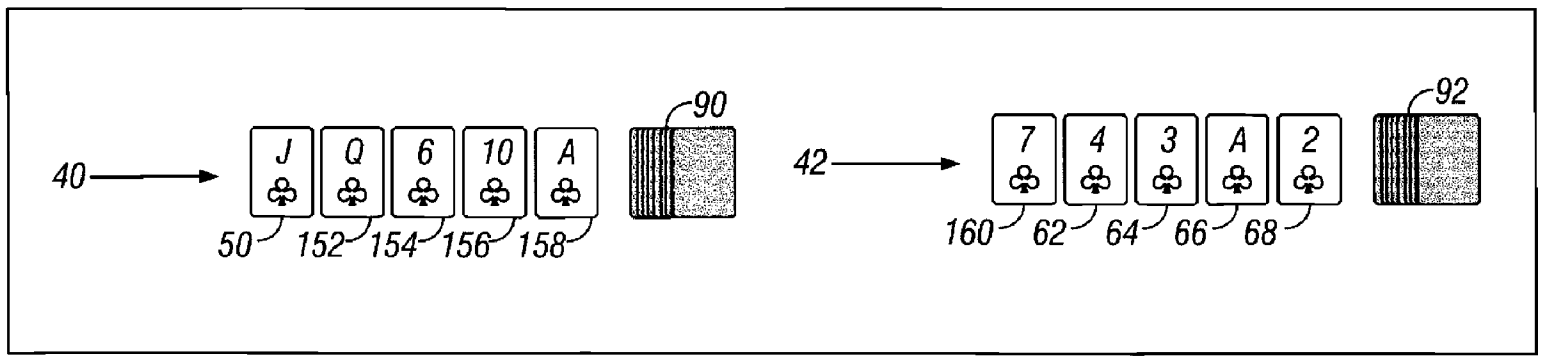
FIG. 8 illustrates two complete hands played in a bonus game in accordance with one embodiment of the invention.

The four replacement cards needed to complete hand 40 are drawn from deck 90, which is the same deck used to deal hand 40. In FIG. 8, cards 152, 154, 156 and 158 have been drawn from deck 90 to complete and form the final hand 40. The replacement card needed to complete hand 42 is drawn from deck 92, the same deck used to deal the original hand 42. In FIG. 8, card 160 is drawn from deck 92 to complete and form the final hand 42.

The final hands 40 and 42 are then evaluated to determine a bonus payout amount for each hand. The payout amount may be determined by comparing each final hand to a standard poker payout table. Since hand 40 is a flush, it will be awarded the payout amount a standard poker payout table allocates for a flush. Hand 42 is also a flush, and will also be awarded a payout based upon the standard poker payout for a flush. Again, an alternative payout table may be used.

The bonus game is offered in conjunction with a main game. The main game can be any type of wagering game, or any type of game available in a casino environment. The main game may be a game provided and played on any type of gaming machine. For example, the main game can be played on a video poker machine, video slot machine or mechanical slot machine. Additionally, the main game can be a mechanical slot machine having a video bonus presentation. Alternatively, the main game can be keno, bingo or other games. Furthermore, the main game can be a card game played at a card table or can be a card game offered on a gaming machine.

The bonus game is a card game that can be played on any type of gaming machine. Additionally, the bonus game is not limited to being played on a machine. Rather, the bonus game can also be played between a dealer and a game player at a table.

Upon activation of the bonus game, play of the main game may be temporarily suspended. It is likely the player will not play the main game while playing the bonus game. However, in an optional embodiment of the invention, play of the main game can continue during play of the bonus game. For example, in a card game having several players participating in the main game, one player can trigger the activation of a bonus game. The one triggering player can begin playing the bonus game while the other players continue to play the main game. Optionally, the one player can play the bonus game while simultaneously continuing to play the main game.

Alternatively, in a main wagering game having several players, once the bonus game is triggered by one player, the bonus game is available for all of the other players to play.

In yet another, optional embodiment of the invention, the bonus game may be delayed. Specifically, once a bonus game has been activated, the player may choose to delay playing the bonus game. If the player opts to delay the bonus game, the player may then choose to return to playing the main game. Alternatively, the player may discontinue playing the main game and not play any game after delaying the bonus game. In yet another alternative embodiment where a player has delayed playing the bonus game, the player may play a new game different from the previously played main game.

If a player delays the bonus game, the player may be able to play the bonus game at any time. For example, the player can delay playing the game for an hour, a month, a year or for any other time period.

Optionally, in another separate embodiment of the invention, a secondary game can be offered in conjunction with the play of a primary game. The secondary game is not necessarily a bonus game. Rather, the secondary game is an additional game. During play of the primary game, the secondary game may be activated upon the occurrence of a predefined event in the primary game. Playing the secondary game includes dealing a hand of cards to a game player from an abridged deck of cards. The abridged deck of cards consists of 13 cards all in the same suit. The game player may discard as few as none of the cards and as many as all of the dealt cards. Each discarded card is replaced with a card drawn from the abridged deck of cards. The payout awarded to the game player is determined by comparing the final hand to a standard poker payout table. In one embodiment of the invention, the game player is dealt five cards in the secondary game. However, in an alternative embodiment, the game player may be dealt more than five cards.

The game player would be permitted to discard and draw replacement cards provided the game player formed a final hand of only five cards. Additionally, it would be possible for the game player to be dealt less than five cards. The game player would be permitted to draw additional cards in order to form a final hand of five cards.

Furthermore, the various methodologies described above are provided by way of illustration only and should not be construed to limit the invention. Those skilled in the art will readily recognize that various modifications and changes may be made to the present invention without departing from the true spirit and scope of the present invention. Accordingly, it is not intended that the present invention be limited, except as by the appended claims.

What is claimed is:

1. A method for playing a secondary game in association with a primary wagering game, the method comprising:

activating the secondary game upon the occurrence of a predefined triggering event in the primary wagering game;

beginning the play of the secondary game by dealing a hand of cards randomly drawn from an abridged deck of playing cards, the abridged deck of playing cards having at least thirteen cards all of a single suit;

forming a final hand by discarding as few as none, and as many as all, of the cards from the dealt hand, wherein each of any discarded cards is replaced by a card from the abridged deck of playing cards; and evaluating the final hand to determine a payout.

2. The method of claim 1, wherein one or more of the playing cards in the abridged deck of playing cards is a wild card.

3. The method of claim 1, wherein evaluating the final hand of cards comprises comparing the final hand of cards to a standard poker payout table to determine the payout.

4. The method of claim 1, further comprising awarding a payout after evaluating the final hand of cards.

5. The method of claim 1, further comprising receiving a request to discard one or more cards in the dealt hand.

6. The method of claim 1, further comprising receiving a request to hold as few as none and as many as all of the cards in the dealt hand.

7. The method of claim 1, further comprising:

dealing one or more than one additional hand of cards, wherein each additional hand is dealt from a different abridged deck of playing cards and each abridged deck of playing cards contains at least thirteen cards all of a single suit;

permitting each of the cards in each additional hand to be discarded and replaced, wherein the particular abridged deck of playing cards used to deal a specific additional hand is the same abridged deck of playing cards used to replace cards discarded from that specific additional hand; and evaluating each of the additional hands and awarding a payout for each of the evaluated hands, wherein each payout is determined by comparing each additional hand to a standard poker payout table.

8. The method of claim 1, further comprising providing the primary wagering game on a gaming machine.

9. The method of claim 1, further comprising providing the primary wagering game on a video poker machine.

10. The method of claim 1, further comprising providing the primary wagering game on a video slot machine.

11. A method for playing a bonus game in association with a main game, the method comprising:

engaging in the play of the main game;

activating the bonus game upon the occurrence of a predefined triggering event in the main game;

beginning the play of the bonus game by dealing five cards randomly drawn from an abridged deck of playing cards, the abridged deck of playing cards having at least thirteen unique cards all of a single suit;

permitting as few as none and as many as five of the dealt cards to be discarded, wherein each discarded card is replaced with a card from the abridged deck of playing cards, thereby forming a final hand of cards; and awarding a bonus payout based on the final hand of cards.

12. The method of claim 11, wherein one or more of the playing cards in the abridged deck of playing cards is a wild card.

13. The method of claim 11, further comprising evaluating the final hand of cards to determine the payout amount before awarding the bonus payout.

14. The method of claim 13, wherein evaluating the final hand of cards comprises comparing the final hand of cards to a standard poker payout table to determine the amount of the bonus payout.

15. The method of claim 11, further comprising:

dealing one or more than one additional hand, wherein each additional hand is dealt from a different abridged deck of playing cards and each abridged deck of playing cards contains at least thirteen unique cards all of a single suit;

permitting each of the cards in each additional hand to be discarded and replaced, wherein the particular abridged deck of playing cards used to deal a specific additional hand is the same abridged deck of playing cards used to replace cards discarded from that specific additional hand; and awarding a bonus payout for each additional hand, wherein each bonus payout is determined by comparing each additional hand to a standard poker payout table.

16. The method of claim 11, further comprising providing the main game on a gaming machine.

17. The method of claim 11, further comprising providing the main game on a video poker machine.

18. The method of claim 11, further comprising providing the main game on a video slot machine.

19. A method for playing a bonus game in conjunction with a main game, the method, under the control of a game player, comprising:

playing a main game having a trigger for activating the bonus game; triggering the activation of the bonus game;

receiving five cards randomly drawn from an abridged deck of playing cards, the abridged deck of playing cards having at least thirteen unique cards all of a single suit;

selecting as few as none or as many as all of the five received cards to remain in the final hand;

discarding cards not selected to remain in the final hand;

drawing replacement cards from the abridged deck of cards to complete the final hand of five cards; and submitting the completed final hand for evaluation to determine a payout award.

20. The method of claim 19, further comprising receiving a payout award based on the comparison of the final hand to a standard poker payout table.

21. The method of claim 19, further comprising receiving one or more than one additional hand of five cards, wherein each additional hand is randomly drawn from a different abridged deck of playing cards and each abridged deck of playing cards contains at least thirteen cards all of a single suit.

22. The method of claim 21, further comprising:

selecting as few as none and as many as all of the cards in each additional poker hand to remain in the final hand;

discarding cards from each additional hand not selected to remain in the final hand;

drawing a card to replace each discarded card, wherein the abridged deck of playing cards used to deal a specific additional hand is the same deck of playing cards used to replace cards discarded from that specific additional hand; and submitting each of the additional hands for evaluation to determine a payout award.

23. The method of claim 19, wherein the abridged deck of cards comprises one or more wild cards.

24. A gaming machine configured to provide a bonus game to be played in conjunction with a main wagering game, the bonus game comprising:

dealing five cards randomly drawn from an abridged deck of playing cards, the abridged deck of playing cards having at least thirteen unique cards all of a single suit; discarding as few as none and as many as all of the dealt cards;

replacing each of any discarded cards with a card drawn from the abridged deck of playing cards; and awarding a bonus payout, wherein the payout is determined by comparing the final hand of cards to a poker payout table.

25. The gaming machine of claim 24, wherein one or more of the playing cards in the abridged deck of playing cards is a wild card.

26. The gaming machine of claim 24, wherein the payout is determined by comparing the final hand of cards to a standard poker payout table.

27. The gaming machine of claim 24, wherein the payout is determined by comparing the final hand of cards to a modified poker payout table.

* * * * *